United States Patent [19]

Boissevain

[11] Patent Number: 4,505,779

[45] Date of Patent: Mar. 19, 1985

[54] METHOD OF MODIFYING A PAPER MACHINE HEADBOX SLICE ROD ASSEMBLY

[75] Inventor: Mathew G. Boissevain, Los Altos Hills, Calif.

[73] Assignee: Measurex Corporation, Cupertino, Calif.

[21] Appl. No.: 417,827

[22] Filed: Sep. 13, 1982

[51] Int. Cl.[3] ..... D21F 1/06

[52] U.S. Cl. ..... 162/199; 162/212; 162/347

[58] Field of Search ..... 162/198, 272, 263, 199, 162/252, 253, 259, 212, 344, 347; 254/93 A

[56] References Cited

U.S. PATENT DOCUMENTS

| | | | |
|---|---|---|---|
| 2,568,437 | 9/1951 | Foss | 254/93 A |
| 2,875,980 | 3/1959 | Grace | 254/93 A |
| 2,934,319 | 4/1960 | Wahlstrom | 254/93 A |
| 2,951,007 | 8/1960 | Lippke | 162/263 |
| 3,135,652 | 6/1964 | Smith | 162/259 |
| 3,321,360 | 5/1967 | Holt | 162/347 |
| 4,358,342 | 11/1982 | Nutall | 162/347 |
| 4,406,740 | 9/1983 | Briew | 162/347 |

*Primary Examiner*—Steve Alvo

*Attorney, Agent, or Firm*—Hal J. Bohner

[57] ABSTRACT

A process for modifying a paper machine headbox manually-adjustable slice rod assembly. The slice rod assembly is cut and a fluid actuator is inserted to permit the assembly to be operated by the fluid actuator in combination with a screw jack.

4 Claims, 3 Drawing Figures

METHOD OF MODIFYING A PAPER MACHINE HEADBOX SLICE ROD ASSEMBLY

BACKGROUND OF THE INVENTION

1. The Field of the Invention

The present invention relates to apparatus and process for adjustment for the position of the slice lip of the headbox of a paper making machine.

2. State of the Art

The headbox of a paper making machine converts the flow of a fibrous suspension, forming a paper slurry, from a stream into a layer corresponding to the width of the sheet to be formed. The headbox takes the form of a reservoir, the front face of which has, towards the bottom, a slot provided with lips, between which the liquid slurry is projected onto a production wire. The purpose of the headbox is to insure a constant delivery and to distribute the slurry over the entire width of the wire, which may be as much as 9 meters in the case of modern installations.

The slurry containing fibres in suspension as well as mineral filler is forced under a constant pressure between the lips. The evenness of the rate of discharge of a layer containing fibres in suspension together with the uniformity of the concentration determine the uniformity of the weight per unit area of the manufactured product. In modern paper making machines, flow takes place between metalic lips, one of which is fixed while the other is movable as a whole so that it adjusts the thickness. Furthermore, the movable lip, which is usually the upper lip, is deformable lengthwise under the action of slice rods which can be moved to control the position of various parts of the slice lip. Conventionally, slice rods are controlled by manually-operated screw jacks. A modern normally includes several dozen of such manually operated screw jacks.

Control of the thickness of the layer of the slurry as it passes through the lips and thus control of weight per unit area of the product at the end of the machine is not very conveniently carried out with the aid of such manually operated screw jacks, the adjustment of which is a delicate matter which gives good results only on a trial and error basis. To eliminate this disadvantage, headboxes have been designed wherein the screwjacks are each controlled by an electric motor-reducer unit which is itself controlled, by way of a computer which receives results of the measurements of paper thickness or basis weight and calculates the corrections to be made on the screw jacks.

These control systems using motor-reducers are not completely satisfactory. In fact, mechanical backlash generally occurs, and precision of adjustment is not very great. However, the greatest drawback is the very high cost of these mechanisms, since the headbox of a modern machine may comprise up to 60 or more of them. Moreover, electrical components can be subject to corrosion.

In addition to motor-reducers, hydraulic means have also been used to control the position of of slice lip. U.S. Pat. No. 2,951,007 describes a hydraulic system for adjusting the movable lip of a headbox. It is apparent from the patent that the hydraulic system for operating the slice lip must be installed on a paper machine headbox when the headbox is originally built. It appears that a headbox having a manually operated screwjack could not be converted to a hydraulically-operated system described in the patent without practically completely rebuilding the headbox.

OBJECTS OF THE INVENTION

On object of the present invention is to provide a system and process for modifying a headbox having manually-adjustable slice rods to permit the rods to be operated by fluid means.

Further objects and advantages of the present invention can be ascertained by reference to the specification and drawings herein which are offered by way of example and not in limitation of the claims.

DETAILED DESCRIPTION OF THE PREFERRED EMBODIMENTS

Figure 1:
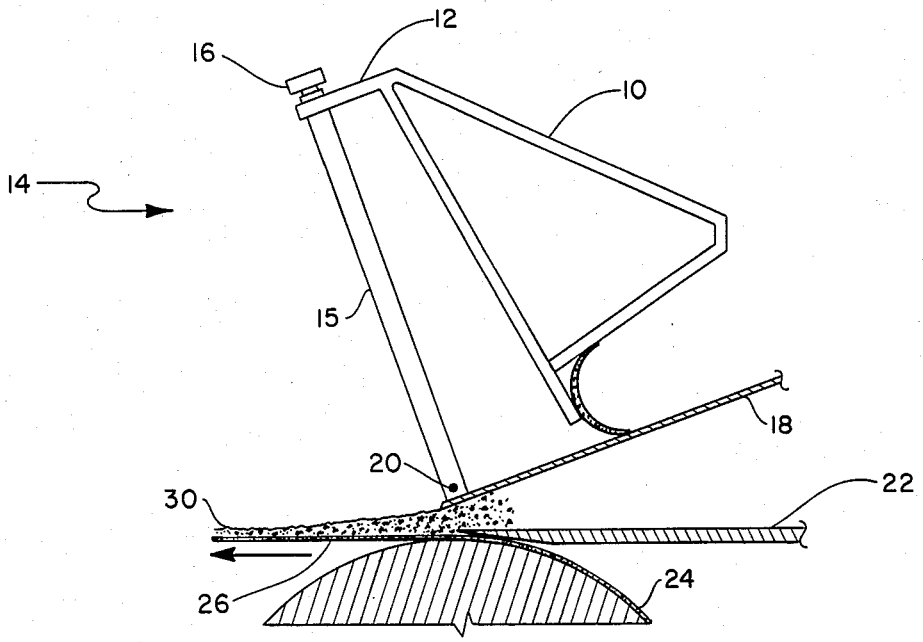
FIG. 1 Prior Art
FIG. 1 diagrammatically shows a section through a portion of a headbox of a paper machine and illustrates a conventional, manually operated slice rod.
Figure 2:
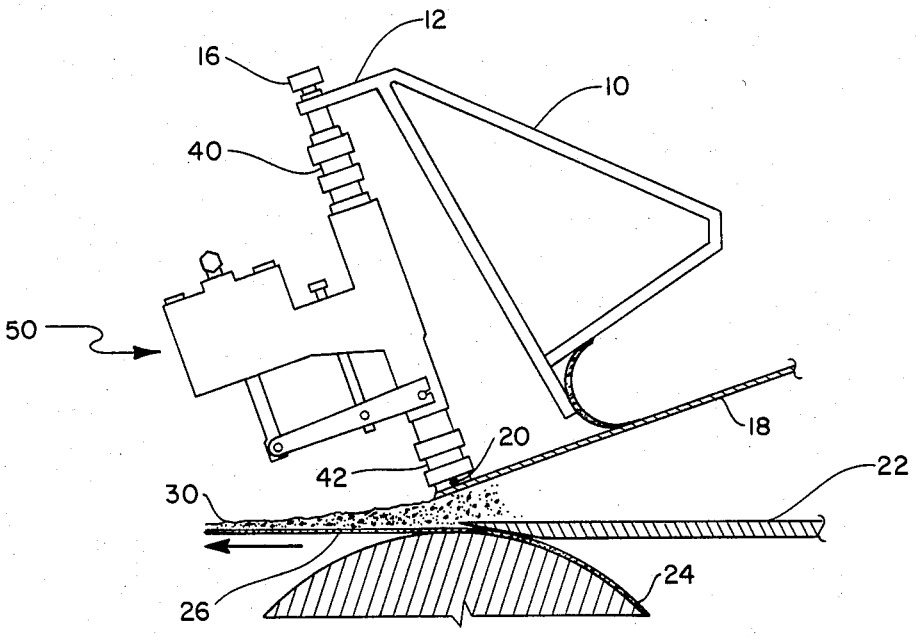
FIG. 2 diagrammatically shows a section through a portion of a headbox of a paper making machine after modification according to the present invention.

FIG. 1 illustrates the cross section of a paper machine showing a conventional, manually-adjustable slice rod prior to modification according to the present process. Only part of the headbox is shown as frame member 10. Coupled to the frame member 10 is a support member 12 for supporting the upper end of the slice rod 14. The slice rod assembly 14 includes a slice rod 15 which is coupled at its upper end to the support member 12 by a hand-operated screw jack 16. The slice rod assembly 14 is conventional and will not be described in detail. However, it should be understood that the screw jack 16 can be rotated by hand to thereby raise and lower the slice rod 15 with respect to the support member 12.

The slice rod 15 is pivotally coupled at its lower end to a slice lip 18 via a coupling pin 20. The slice lip 18 is flexible and opposes a lower, stationary slice lip 22. Thus it can be seen that rotation of the screw 16 causes displacement of the upper slice lip 18 with respect to the lower slice lip 22. A breast roll 24 is disposed below the lower slice lip 22, and a porous screen 26 formed of metal or plastic is mounted around the breast roll 24 to carry the paper slurry 30.

When it is desired to convert the manually-controlled system shown in FIG. 1 to a fluid-controlled system according to the present process, the slice rod 15 is cut at two points. Preferably one cut is made near the upper end of the slice rod 15 just below the screw 16 and the when cut is just above the pin 20. Then the part of the rod between the two cuts is removed and a fluid actuation means according to the present system is inserted in place of the removed portion of the slice rod 15. Then the fluid actuation means is rigidly coupled to the remaining portions of the slice rod 15 by upper coupling 40 and lower coupling 42. Thereafter, the fluid actuation means can be used to adjust the upper slice lip 18. In addition to adjustments accomplished by the fluid actuation means, the screw 16 can still be used to adjust the upper slice lip 18.

Figure 3:
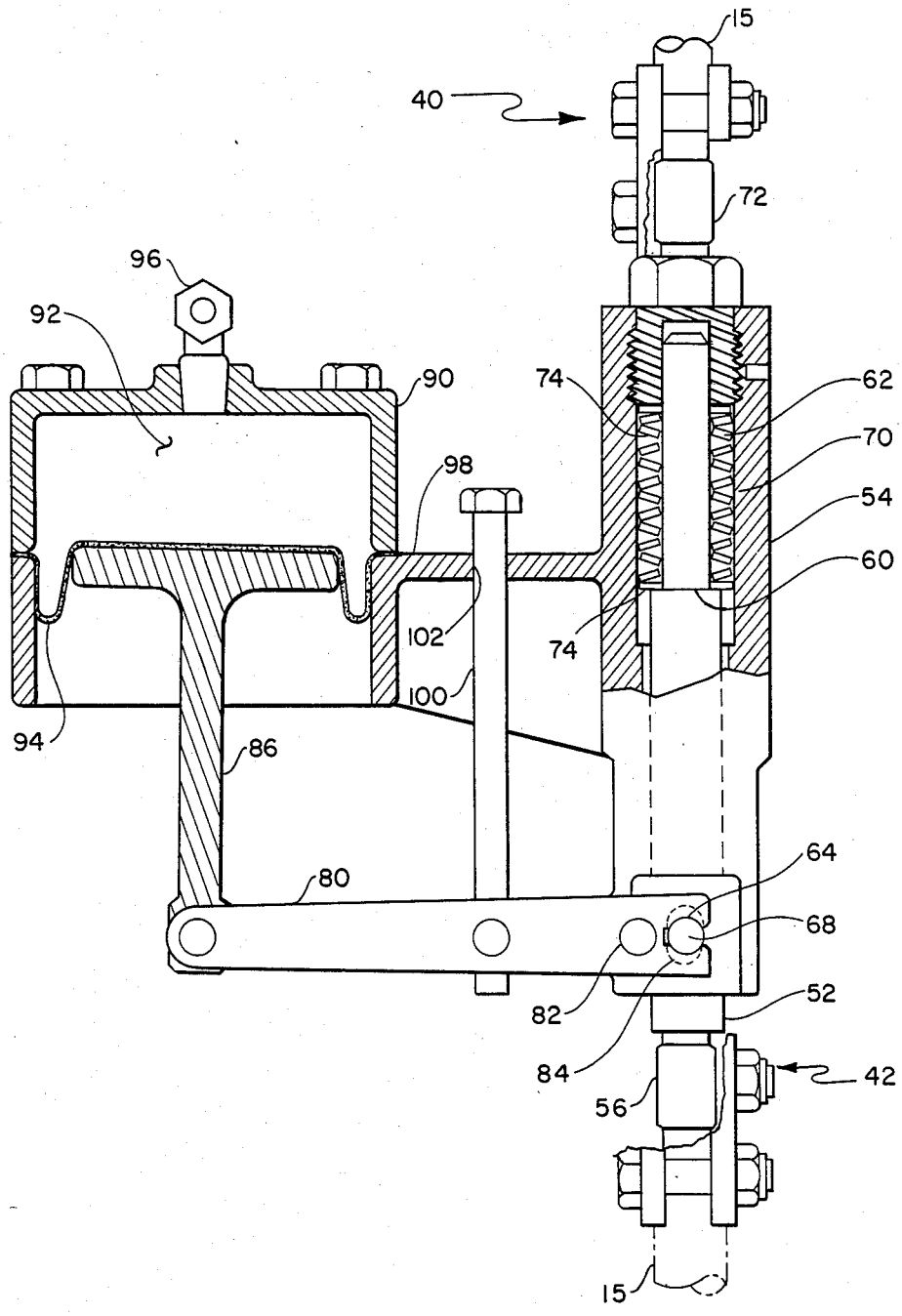
FIG. 3 shows a fluid actuation means according to the present system.

The fluid actuation means 50 is shown in detail in FIG. 3. The fluid actuation means 50 includes a rod 52 which is slidingly disposed within a sleeve 54. The rod 52 is threaded at its lower end 56 to cooperate with the lower coupling means 42 to be rigidly connected to the part of the slice rod 15 which is coupled to the pin 20, not shown. The upper end of the rod 52 is of a substantially smaller diameter than the lower end of the rod 52 so that a shoulder 60 is formed near the upper end of the rod. The shoulder 60 of the rod 52 is designed to cooperate with a spring system 62 which will be discussed in detail hereinafter. The rod 52 has a cylindrical hole 64 formed through its diameter to receive a pin 68. Thus, as the pin is moved up and down the rod 52 is correspondingly moved.

The sleeve 54 is substantially cylindrical and contains a cylindrical bore 70 to accept the rod 52. The sleeve 54 at its upper end includes a threaded connecting member 72 which in turn cooperates with the upper coupling 40 to provide a rigid connection to the upper portion of the slice rod 15. The spring system 62 is located in the upper end of the bore 70 and comprises a plurality of cylindrical washers 74. The washers 74 are of the type called "Belleville" washers, and are not flat, but shaped generally in the form of a truncated cone.

A lever 80 is coupled to the lower end of the sleeve 54 via a pivot 82. And the right end of the lever 80 is coupled to the pin 68. A port 84 is formed in the lower end of the sleeve 54 to permit the pin 68 to move up and down as the lever rotates about the pin 82. The left end of the lever 80 is pivotally coupled to the lower end of piston assembly 86. The upper end of the piston assembly 86 fits within a cylinder assembly 90 which has a cavity 92 formed above the piston assembly 86. A diaphram 94 is connected to the lower side of the cavity 92 to form a fluid-tight cavity so that as to the cavity is filled with fluid the piston assembly is forced downward and as fluid is removed from the cavity 92, the piston assembly is moved upward. A coupling 96 is provided at the upper end of the cylinder assembly 90 to permit introduction and removal of fluid from the cavity 92. The cylinder assembly 90 is rigidly coupled to the sleeve 54 by support 98. A bolt member 100 is coupled at its lower end to the lever 80 and at its upper end fits within a port 102 formed in the support 98. Thus, the bolt 80 restricts the distance which the lever 80 can travel downward.

Thus, in operation, as fluid is introduced into the cavity 92 the left end of the lever 80 is forced downward. This forces the pin 68 to move upward about the pivot 82, and consequently the rod 52 is forced upward. This, or course, causes the upper slice lip 18 to move upward. On the other hand, when it is necessary to move the upper slice lip 18 downward, liquid is removed from the cavity 92. It should be understood that when fluid is removed from the cavity 92 the springs 62 force the rod 52 downward; whereas when the rod is forced upward, the springs are loaded.

It should be understood that rather than cutting the slice rods, the complete rod could be removed from the slice rod assembly and the fluid actuation means 50 could then be coupled directly to the slice lip 18 and the screw 16.

I claim:

1. A process for modifying a paper machine headbox manually-adjustable slice rod assembly including a screw jack to permit the assembly to be operated by a fluid actuator in combination with the screw jack and without modifying the structure which supports the assembly, wherein the manually-adjustable slice rod assembly includes a coupler connecting the assembly to a slice lip, the process comprising:

(a) cutting the slice rod assembly at two points between the screw jack and the coupler, the two points being located so as not to affect the screw jack and so as not to affect the coupler;

(b) removing the section of the slice rod assembly between the two cuts while leaving the screw jack in place coupled to the support structure;

(c) inserting a fluid actuator in the position previously occupied by the section of the rod which was removed; and (d) rigidly coupling the fluid actuator to the sections of the rod which were not removed.

2. The process of claim 1 wherein the fluid actuation means includes a rod which is slideable in a sleeve, and the rod is coupled to the slice rod at one location where the slice rod was cut, and the sleeve is coupled to the slice rod at the other location where the slice rod was cut.

3. The process of claim 1 wherein the fluid actuator includes a rod and sleeve assembly which is coupled to the slice rod and further includes a fluid actuated cylinder and piston assembly coupled to the rod and sleeve assembly to cause the rod to slide within the sleeve.

4. A process for modifying a paper machine headbox manually-adjustable slice rod assembly including a screw jack, to permit the assembly to be operated by a fluid actuator in combination with the screw jack and without modifying the structure which supports the assembly, wherein the manually-adjustable slice rod assembly includes a coupler connecting the assembly to a slice lip, the process comprising:

(a) removing a section of a slice rod assembly between two points on the assembly between the screw jack and the coupler while leaving the screw jack in place coupled to the support structures;

(b) inserting a fluid actuator in the position previously occupied by the section of the rod which was removed; and (c) rigidly coupling the fluid actuator to the sections of the rod which were not removed.

* * * * *